United States Patent [19]

Coleman et al.

[11] 4,208,013

[45] Jun. 17, 1980

[54] PORTABLE CHEMICAL SPRAYING APPARATUS WITH DISPOSABLE CHEMICAL CONTAINER

[75] Inventors: Bobby W. Coleman; John R. Frassanito; Richard O. Norman; James G. Parke, all of San Antonio, Tex.

[73] Assignee: Micro-Gen Equipment Corporation, San Antonio, Tex.

[21] Appl. No.: 774,785

[22] Filed: Mar. 7, 1977

[51] Int. Cl.[2] ..... B05B 7/30

[52] U.S. Cl. ..... 239/351; 222/325

[58] Field of Search ..... 239/309, 346, 351, 310, 239/318, 355, 352; 222/333, 372, 373, 401, 325, 180

[56] References Cited

U.S. PATENT DOCUMENTS

| | | | |
|---|---|---|---|
| 1,080,835 | 12/1913 | Kelley | 222/401 X |
| 1,875,729 | 9/1932 | Hermann | 239/351 |
| 1,881,570 | 10/1932 | Hermann | 239/351 X |
| 2,887,272 | 5/1959 | Rosenthal | 239/309 X |
| 2,990,979 | 7/1961 | Harrison et al. | 222/174 X |
| 3,833,177 | 9/1974 | Pasley | 239/309 |
| 3,993,250 | 11/1976 | Shore | 239/332 |
| 4,033,511 | 7/1977 | Chamberlin | 239/346 |

FOREIGN PATENT DOCUMENTS

| | | | |
|---|---|---|---|
| 1029546 | 5/1958 | Fed. Rep. of Germany | 239/346 |
| 859114 | 1/1961 | United Kingdom | 239/351 |

*Primary Examiner*—Robert B. Reeves
*Assistant Examiner*—Gene A. Church
*Attorney, Agent, or Firm*—Cox & Smith Incorporated

[57] ABSTRACT

A portable chemical spraying apparatus has an electric motor/compressor mounted inside of two halves of a lightweight housing. A compressed air output of the motor/compressor connects directly to a compression chamber. Compressed air inside of the compression chamber moves through the venturi of a nozzle into a mixing chamber. The mixing chamber opens to atmosphere through a vortex of compressed air received via spiral passages connecting to the compression chamber. Chemicals may be drawn into the mixing chamber through a needle, which may perforate a seal of a disposable chemical container at the time the chemical container is connected to the portable spraying apparatus. Simultaneously, the needle seals with a metered conduit which extends to the inside bottom of the chemical container.

14 Claims, 11 Drawing Figures

PORTABLE CHEMICAL SPRAYING APPARATUS WITH DISPOSABLE CHEMICAL CONTAINER

BACKGROUND OF THE INVENTION

This invention relates to a chemical spraying apparatus and, more particularly, to a portable chemical spraying apparatus having a quick connecting, sealed, disposable chemical container for connection therewith. Compressed air from a motor/compressor discharges into a compression chamber having a nozzle mounted in a wall thereof. The nozzle, through venturi action, draws chemicals through a metered conduit from the chemical container for discharge to atmosphere. Simultaneously, with the discharge to atmosphere, a turbulence is created by a vortex of air through spiral passages connecting to the compression chamber.

BRIEF DESCRIPTION OF THE PRIOR ART

Many different types of chemical spraying apparatuses have been used in the past. Included in the prior art are spraying apparatuses having an elevated pressurized mixture discharged to the atmosphere through a nozzle utilizing a venturi for drawing the chemical insecticide into the nozzle. Also, some of the prior art show vortex arrangements for creating a turbulence in the nozzle, either prior to, and/or at the time of the discharge of the mixture of insecticide and air to atmosphere. Earlier patents having the same assignee as the present invention showing similar nozzles are U.S. Pat. Nos. 3,793,762; 3,648,401 and 3,900,165.

Referring specifically to U.S. Pat. No. 3,900,165, FIG. 3 shows a cross-sectional view of a nozzle housing with the nozzle body being located therein. The nozzle body includes an orifice opening into a mixing chamber, and converging spiral passages to give a vortex type turbulence prior to the discharge of the insecticide and air to atmosphere.

Other patents, such as U.S. Pat. No. 3,833,177, disclose fluid bottles having seals that may be perforated prior to the dispensing of the fluid as can be seen in FIGS. 1, 2 and 3. However, all of the prior art known to applicant uses some type of threadable or other more complex means for connecting the chemical container to the spraying apparatus. Many times the container must be secured in place on the spraying apparatus, as well as secured to a conduit to the inside of the container to draw the insecticide therefrom. Also various metering valves would have to be adjusted depending upon the insecticide being used, or the air pressure. While such an arrangement may be practical for business enterprises, the general public needs a very simple, easy to use, disposable chemical container that may be connected to the spraying apparatus with the minimum of effort. The connection between the chemical container and the spraying apparatus should be as foolproof as possible.

SUMMARY OF THE INVENTION

It is an object of the present invention to provide a combination spraying apparatus and disposable chemical container that may be connected to the spraying apparatus with a minimum of effort.

It is another object of the present invention to provide a chemical suction conduit extending downward from the spraying apparatus for perforating a seal in a disposable chemical container when the disposable chemical container is clipped in position, and simultaneously seal with a metered conduit inside the chemical container.

It is yet another object of the present invention to provide an easily detachable nozzle from a spraying apparatus which nozzle may be easily cleaned upon removal.

It is still another object of the present invention to provide a disposable chemical container having a chemical suction conduit extending downward from the spraying apparatus and sealed inside of the mouth of the chemical container to a metered conduit extending to the bottom of the container. The metering of the metered conduit includes a restriction that is dependent upon the chemical contained in the chemical container thereby insuring the proper amount of chemical flow. The chemical container further has an indentation for clipping the container into place on a tab extending from the spraying apparatus.

In the present chemical spraying apparatus, a motor/-compressor is mounted in a lightweight housing formed from two separate halves. The compressed air from the motor/compressor connects directly to a pressure chamber in which the nozzle is mounted. The nozzle has a venturi that connects from the pressure chamber into a mixing chamber, which venturi creates a vacuum that sucks chemicals from a chemical container. The nozzle further has a vortex for creating turbulence for mixing of the air and chemicals at the time of discharge to atmosphere. The connection from the nozzle to the chemical container is through a needle conduit which may perforate a seal at the top of the chemical container when the chemical container is clipped into position on the spraying apparatus for carrying therewith. Inside of the mouth of the chemical container is a seal for simultaneously sealing between the needle conduit and a metered conduit at the time the chemical container is clipped into position. The metered conduit extends to the bottom of the chemical container.

By use of the present invention, there is no need to mix chemical insecticides with the attendant danger of spillage causing personal injury or property damage. The pre-metering by an orifice restriction inside the container insures that the correct amount of insecticide is being dispersed. This further insures the optimum driplet size is obtained by the insecticide being sprayed.

DESCRIPTION OF THE PREFERRED EMBODIMENT

Figure 1:
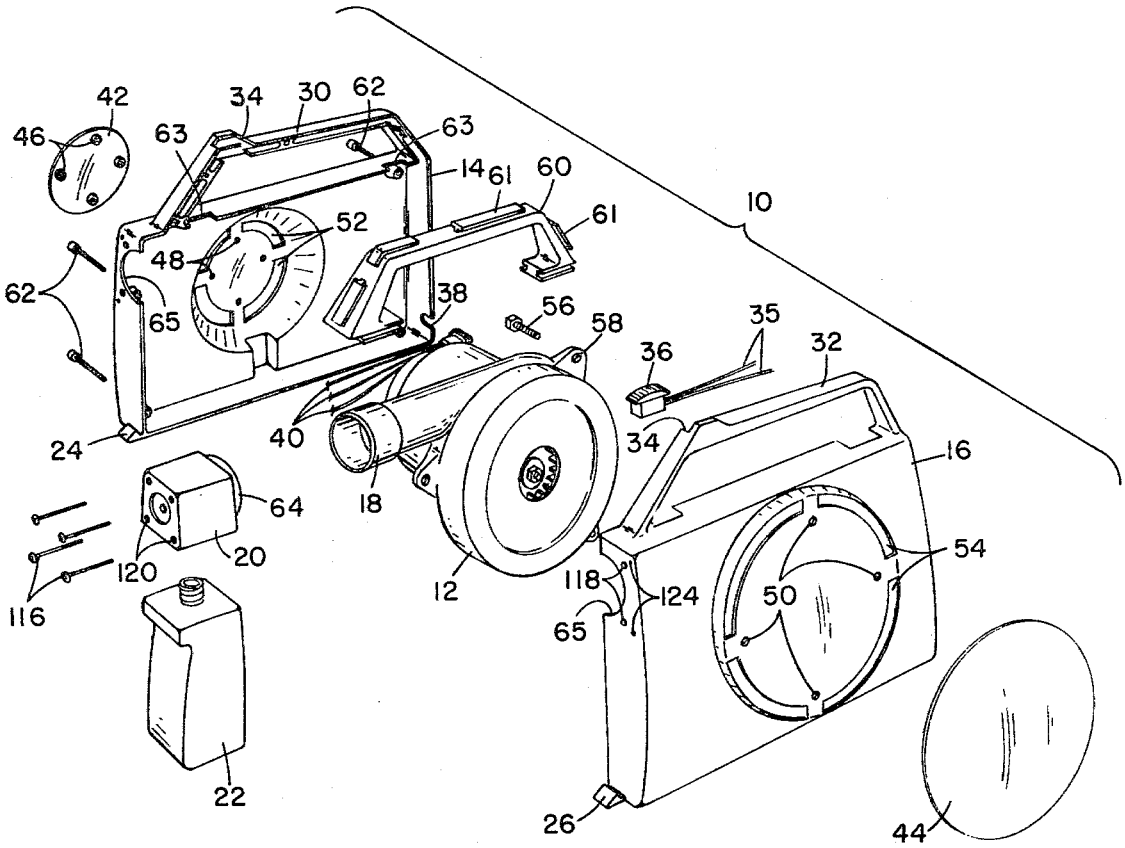
FIG. 1 is an exploded perspective view of the spraying apparatus and disposable chemical container.

Referring to FIG. 1 of the drawings, there is shown a portable sprayer represented generally by reference numeral 10. The portable sprayer 10 includes a motor/-compressor 12 that is mounted inside of a lightweight housing formed in halves 14 and 16. Attached to the output 18 of motor/compressor 12 is a nozzle assembly 20. Chemical container 22 is designed for connection to nozzle assembly 20 and to be held in position by locking tabs 24 and 26 formed on halves 14 and 16, respectively, of the lightweight housing. Hereinafter, both halves 14 and 16 of the lightweight housing, when referred to as one unit, will be given reference numeral 28.

Formed with each of the halves 14 and 16 of the lightweight housing 28 are handles 30 and 32, respectively. In slots 34 of handles 30 and 32 is located a control switch 36. Power for the control switch 36 is received through opening 38 in the rear of lightweight housing 28 and through the handles 30 and 32 (which are hollow) via leads 35. From control switch 36, power is connected to one of the leads 40 of motor/compressor 12. The other of the leads 40, with one lead being ground, connect directly through the power lead (not shown) that extends through opening 38.

Prior to the connection of halves 14 and 16 of lightweight housing 28, nameplates 42 and 44 are connected thereto. Each of the nameplates 42 and 44 have threaded bosses 46 thereon as can be seen on nameplate 42. The threaded bosses 46 for nameplate 42 are threadably connected through holes 48 by bolts that extend from the inside of lightweight housing 28. Likewise, nameplate 44 is bolted onto lightweight housing 28 via holes 50.

To allow for cooling of the motor portion of motor/-compressor 12, slots 52 are located in half 14 of lightweight housing 28. Air being compressed by motor/-compressor 12 is drawn into the lightweight housing 28 through slots 54 on half 16.

After connection of the electrical system via control switch 36 to motor/compressor 12, and connection of the nameplates 42 and 44, the portable sprayer 10 is ready for assembly. In assembly, the motor/compressor 12 is bolted to half 16 via bolts 56 that extend through holes 58 for connection to internal threaded bosses (not shown) of half 16. A handle cushion 60 is located inside of handles 30 and 32 and held in position by extensions 61. The extensions 61 are received in notches 63 of handles 30 and 32. Thereafter, halves 14 and 16 are bolted together via bolts 62 that extend through half 14 and threadably connect to threaded bosses (not shown) in half 16.

Figure 2:
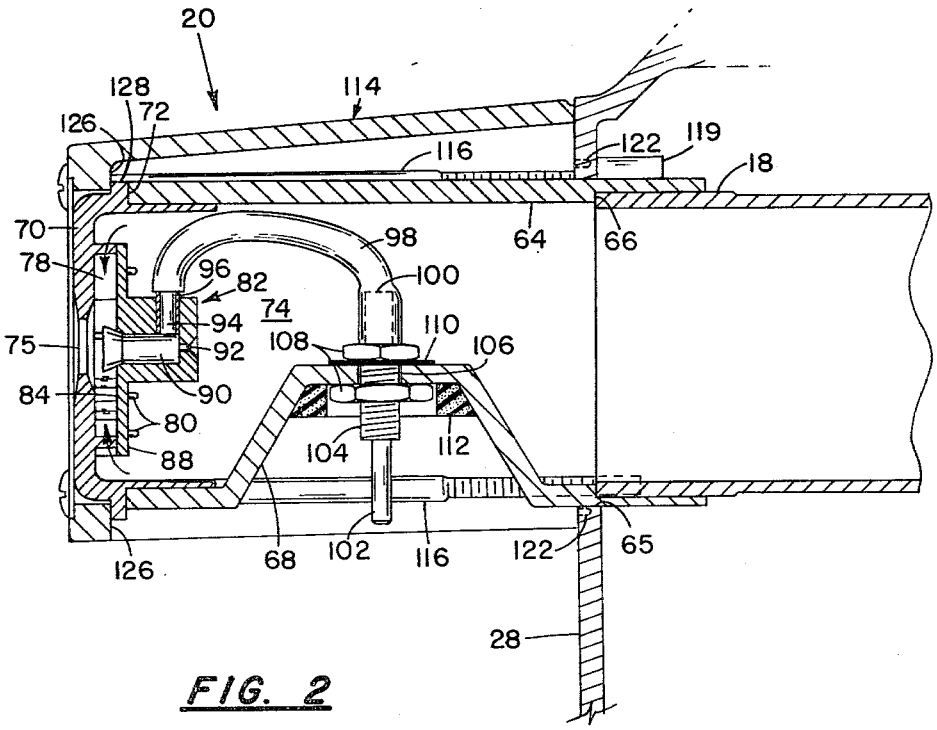
FIG. 2 is an elevated cross-sectional view of the nozzle portion of the spraying apparatus shown in FIG. 1.

Referring to FIG. 2, an enlarged cross-sectional view of the nozzle assembly 20 is shown. The nozzle assembly 20 has a molded conduit 64 designed for receiving the output 18 of the motor/compressor 12 therein in a force fit relationship. The force fit of the output 18 will be received inside of molded conduit 64 until the output 18 abuts shoulder 66. The lower portion of molded conduit 64 has a recess 68 therein for receiving the opening of chemical container 22 (hereinafter explained in more detail). The forward end of the molded conduit 64 has a nozzle cap 70 secured therein in a force fitting relationship. The forward end of the molded conduit 64 abuts the shoulder 72 of the nozzle cap 70 in a force fitting relationship to maintain pressure inside of the molded conduit 64 which forms pressure chamber 74.

Figure 3:
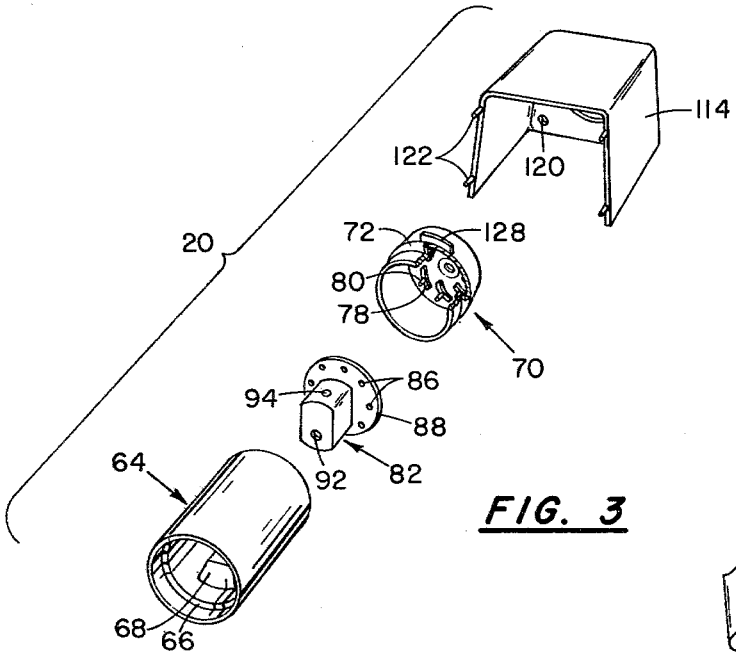
FIG. 3 is an exploded perspective view of the nozzle portion shown in FIG. 2.

The center of the nozzle cap 70 has a nozzle opening 75 for discharge of a mixture of chemicals and air to atmosphere as will subsequently be described in more detail. Formed integral with the nozzle cap 70 is a series of spiral vanes 78. Extending further into the pressure chamber 74 from the spiral vanes 78 is a series of pins 80. Nozzle body 82 has a forward face that fits flush against the inner surface of spiral vanes 78. The pins 80 extending into the pressure chamber 74 from the spiral vanes 78 snap into holes 86 of the front flange 88 of the nozzle body 82 (see FIG. 3).

Opening from the pressure chamber 74 into a mixing chamber 90 of the nozzle body 82 is an orifice 92. Vacuum is created in perpendicular opening 94 by pressurized air flowing from the pressure chamber 74 through the orifice 92 perpendicular to the opening 94. Perpendicular opening 94 is connected by means of a force fit conduit 96 to flexible hose 98. The opposite end of flexible conduit 98 connects to rigid conduit 100. The rigid conduit 100 is threadably connected to needle conduit 102 by means of threaded connector 104. The threaded connector 104 extends through opening 106 in the recess 68 of molded conduit 64. The threaded connection 104 is held into place by nuts 108. A gasket 110 prevents the escape of pressurized air from pressure chamber 74 through opening 106. Bonded inside of recess 68 around the threaded connector 104 is a porous foam material 112.

Surrounding the portions of the nozzle assembly 82 just described is a nozzle cover 114 that is held into position by bolts 116. The bolts 116 extend into threaded holes 118 which have internally threaded bosses 119 (see FIGS. 1 & 2). As the bolts 116 extend through holes 120 of nozzle cover 114 for threadable connection with threaded bosses 119 of lightweight housing 28, tabs 122 on nozzle cover 114 are received in tab holes 124 of lightweight housing 28 (see FIG. 1). Internally, the nozzle cover 114 has a shoulder 126 that abuts a tab 128 of nozzle cap 70. The abutting of shoulder 126 with tab 128 of nozzle cap 70 securely pushes the nozzle cap 70 inside of molded conduit 64. Simultaneously, it securely pushes molded conduit 64 over the output 18 of motor/compressor 12.

Figure 4:
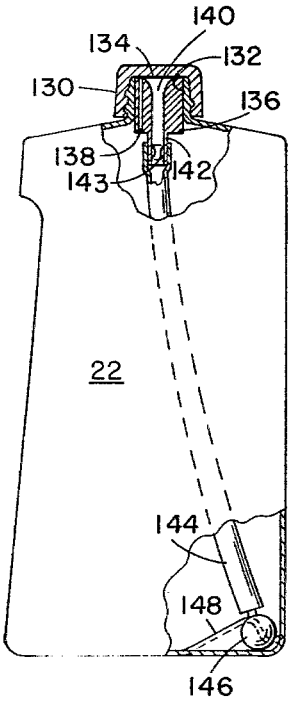
FIG. 4 is an elevated side view of the chemical container with partial sectional views to show internal structure.

Referring to FIG. 4, the chemical container 22 is shown in more detail. During shipment, the chemical container 22 will have a cap 130 threadably connected over an upper opening 132. After removal of the cap 130, a thin seal member 134 will remain over upper opening 132. Inside of upper opening 132 is a flexible needle conduit seal member 136 that is secured in position by any suitable means such as a force fit or bonding to make removal therefrom difficult. This helps to protect against damage from chemicals that should not be used with the portable sprayer 10. The needle conduit seal member 136 has a vent opening 138 extending from the opening 132 to the lower internal portion of chemical container 22.

Inside of the needle conduit seal member 136 is an opening 140 for sealably receiving needle conduit 102. The upper portion of opening 140 is generally funnel shaped to aid in receiving of needle conduit 102 as will subsequently be described in more detail. The lower portion of opening 140 is connected through a short rigid conduit 142 to flexible conduit 144. The lower end of flexible conduit 144 has a weighing device 146 connected thereto; the weighing device 146 insuring that all of the chemicals in chemical container 22 may be drawn through flexible conduit 144. Inside of rigid conduit 142 is an orifice restriction 143, the size of which depends upon the insecticide being dispersed. The orifice restriction 143 is set to optimize the droplet size for the particular insecticide, the insecticide being preselected and the pressure being fixed.

Figure 7:
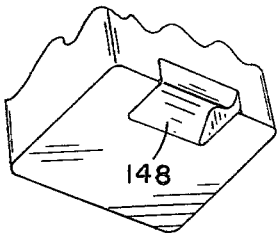
FIG. 7 is a lower partial perspective view of the chemical container shown in FIG. 1.

The lower portion of the chemical container 22 is cross-sectioned in FIG. 4 to illustrate a recess 148 in the container 22. The recess 148 is located in the lower rear center portion of container 22, as can be more clearly seen in the partial lower perspective view shown in FIG. 7. The recess 148 is particularly designed for receiving the locking tabs 24 and 26 of the lightweight housing 28 (see FIG. 1).

Figure 5:
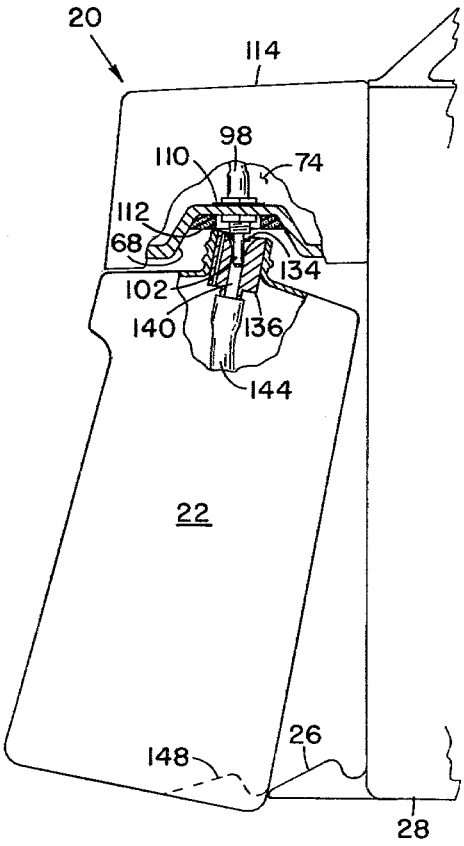
FIGS. 5 and 6 are sequential elevated side views of the chemical container being connected to the spraying apparatus shown in FIG. 1 with a partial sectional of the nozzle and container to illustrate connection of the chemical container to the spraying apparatus.
Figure 6:
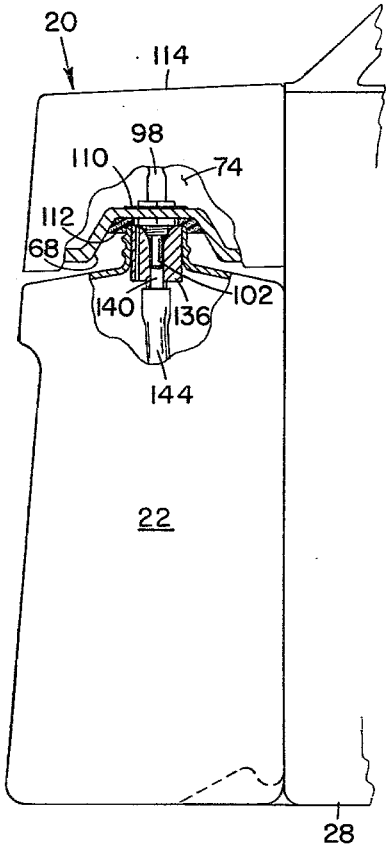

Referring now to FIG. 5, the simplified method of attaching the chemical container 22 to the portable sprayer 10 is illustrated in detail. The cap 130 of the chemical container 22 is removed, and the needle conduit 102 ruptures the thin seal member 134, when the container 22 is positioned as shown in FIG. 5. Upon pushing the chemical container 22 over the locking tabs 24 and 26 of lightweight housing 28, as shown in FIG. 6, the chemical container 22 is securely held in position and the needle conduit 102 seals with needle conduit seal member 136. The porous foam 112 prevents any of the chemical from splashing out of the chemical container 22, yet still allows air to be drawn into the chemical container 22 through vent opening 138 thereby preventing a vacuum in chemical container 22.

Upon plugging the portable sprayer 10 into a suitable electric outlet, and turning the control switch 30 ON, the motor/compressor 12 will force compressed air into compression chamber 74. The compressed air will flow through orifice 92 into mixing chamber 90 thereby creating a vacuum in perpendicular opening 94. The vacuum created in perpendicular opening 94 draws the chemical from chemical container 22 into the mixing chamber 90. The combination of air and chemical in mixing chamber 90 is discharged to atmosphere through nozzle opening 76. Immediately prior to or at the time of discharge, the mixture of chemical and air is subjected to a turbulence created by a vortex of air flowing through spiral vanes 78. The turbulence created by both the orifice 92 and the spiral turbulence of air through vanes 78 breaks the chemical into minute particles at the time of discharge through nozzle opening 76.

ALTERNATIVE EMBODIMENT

Figure 8:
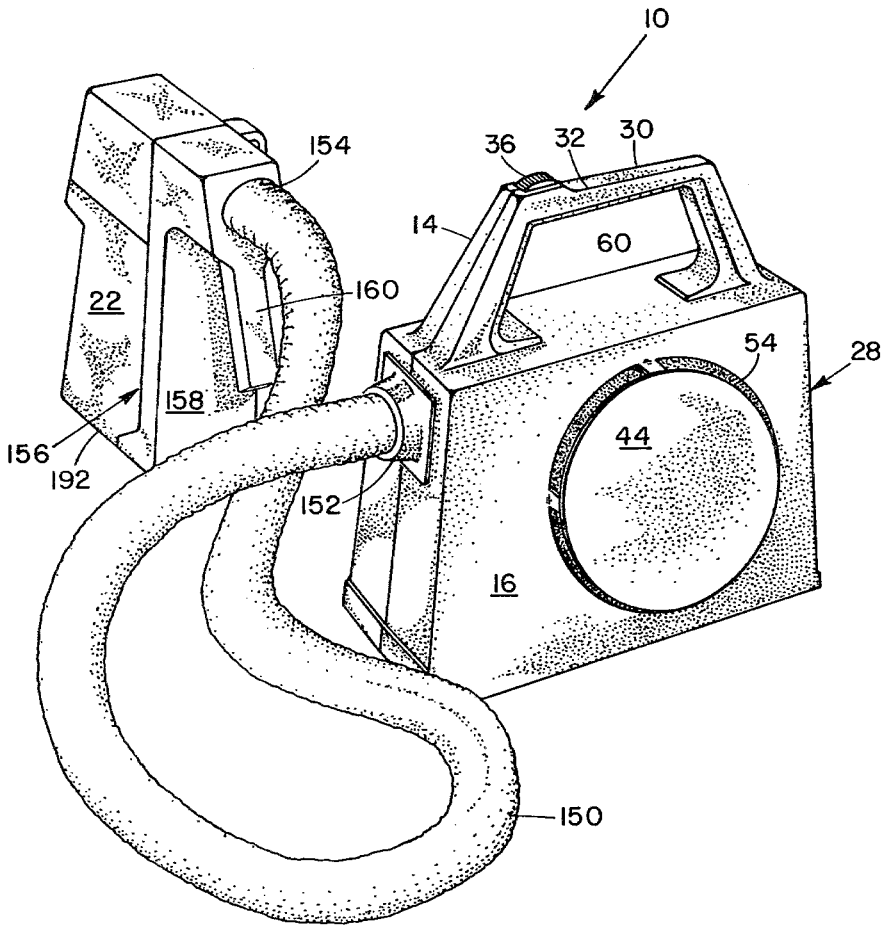
FIG. 8 is a perspective view of an alternative spraying apparatus with a remote nozzle and disposable chemical container.

Referring now to FIG. 8 of the drawings, an alternative embodiment of the portable sprayer 10 is shown. Like numbers previously used for the same component parts in the preferred embodiment will again be used in this alternative embodiment. In the alternative embodiment, the lightweight housing 28 and the halves 14 and 16 do not have mounting structure on the front thereof for mounting chemical container 22. Instead, a flexible hose 150 is connected to the output 18 of the motor/-compressor 12 (see FIG. 1) via grommet 152. The opposite end of the flexible hose 150 connects through hole 154 into the upper rear of container/nozzle mounting structure 156. The container/nozzle mounting structure 156 has a container support 158 and a handle 160.

Figure 11:
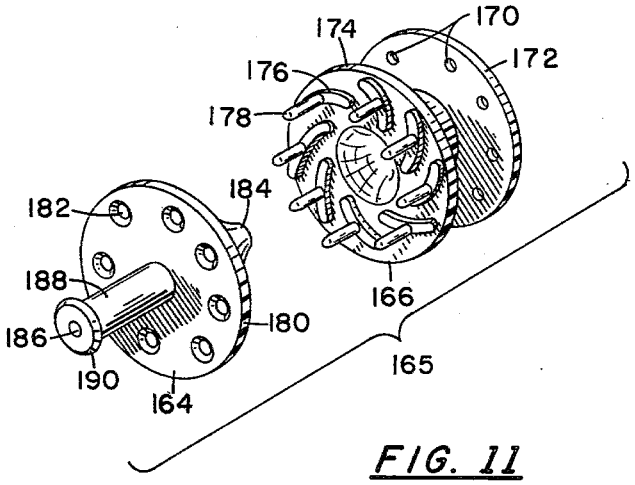
FIG. 11 is an exploded perspective view of some components of the nozzle portion shown in FIG. 10.
Figure 10:
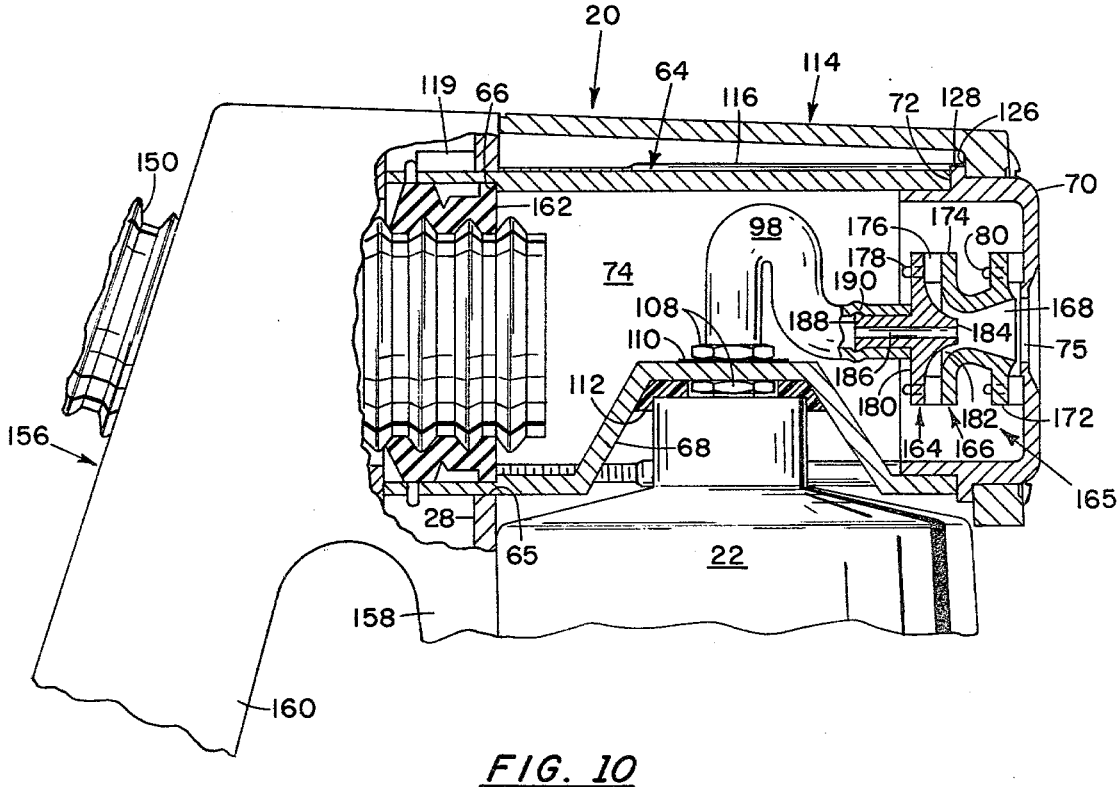
FIG. 10 is a partial elevated sectional view of the nozzle portion of the spraying apparatus shown in FIG. 8.

The container/nozzle mounting structure 156 has a grommet 162 for retaining the hose 160 in fluid communication with molded conduit 64 of the nozzle assembly 20. The grommet 162 pushes against the shoulder 66 of molded conduit 64 to seal therewith. Connection of the nozzle assembly 20 to the container/nozzle mounting structure 156 is basically the same as the preferred embodiment shown in FIGS. 1 and 2. However, the nozzle body 82 as previously shown in detail in FIGS. 2 and 3 has been replaced by a chemical feed portion 164 and a mixing portion 166 to give a dual vortex nozzle 165. The nozzle cap 70 is the same as previously described. Referring specifically to FIGS. 10 and 11 in combination, the mixing portion 166 has a mixing chamber 168 contained therein. The mixing portion 166 is mounted on pins 80 by means of holes 170 in forward flange 172. Spiral veins 176 are located on a rear flange 174 for directing the compressed air inward from pressure chamber 74 to mixing chamber 168. Pins 178 are formed on the spiral veins 176.

The chemical feed portion 164 has an outward flange 180 with holes 182 located therein for receiving pins 178. The spiral veins 176, in conjunction with the shape of the chemical feed portion 164 and the mixing portion 166, form a converging spiral passage 182 which allows pressurized air from pressure chamber 74 to flow over the end 184 of the chemical feed portion 164. Since a chemical flow passage 186 connects from flexible conduit 98 via connecting stem 188 to the end 184, the flowing of pressurized air over the end 184 creates a vacuum in chemical flow passage 186. The vacuum draws fluid from the container 22 via flexible conduit 98. A raised ring 190 in the connecting stem 188 helps maintain flexible conduit 98 on the connecting stem 188.

Other than having the nozzle assembly 20 and the chemical container 22 on a flexible hose that may be moved in any direction with respect to the lightweight housing 28, the function of the portable sprayer 10 as shown in the alternative embodiment of FIG. 8 is basically the same as the preferred embodiment. The chemical container 22 may be easily connected to the container/nozzle mounting structure 156, the same as the chemical container 22 is connected to the lightweight housing 28 in FIG. 1. Also, by the connection of the flexible hose 150 through hole 154 in the upper rear portion of the container/nozzle mounting structure 156, the container 22 may be set on its base 192 without tipping over or spillage.

Figure 9:
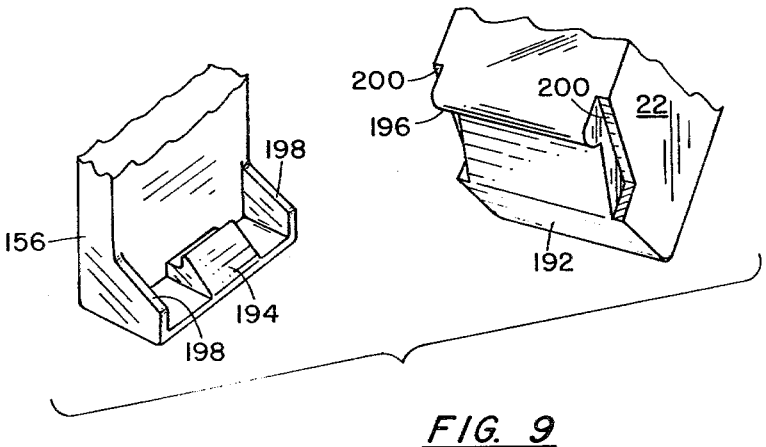
FIG. 9 is a lower partial perspective exploded view of the chemical container and mounting structure shown in FIG. 8.

Referring to FIG. 9, an alternative means of connecting the chemical container 22 to the mounting structure 156 is shown. The mounting structure 156 has a locking tab 194 for extending below a forward lower rib 196 of the chemical container 22. Side supports 198, which are received in indentations 200 of chemical container 22, prevent lateral movement of the chemical container 22 when connected into position.

We claim:

1. A portable spraying apparatus comprising:
   an air compressor driven by a suitable drive means;
   a housing enclosing said compressor and drive means;
   a nozzle housing removably attached to said housing means, said nozzle housing having a pressure chamber for receiving compressed air from said compressor;
   nozzle means attached to a wall of said pressure chamber, said nozzle means including an orifice communicating between said pressure chamber and a mixing chamber of said nozzle means, said orifice creating a vacuum in a first conduit extending from said mixing chamber to a first half of a mating means outside said pressure chamber;

a container adapted for holding liquid chemical therein, a second half of said mating means mounted on and communicating with said container for sealing with said first half of said mating means upon said container being connected to said housing means;

said liquid chemicals being drawn through said mating means and mixed in said mixing chamber with air from said compressor and subsequently discharged to atmosphere;

said mating means comprising a male portion and a female portion;

said container and said housing having mating extensions and indentations for attaching said container to said housing and for urging said container upward;

said first half of said mating means is said male portion, and said second half of said mating means is said female portion for sealably receiving said male portion;

a seal over a container opening, said seal being a paper-like seal for ease of rupture by said male portion, said container having a flexible structure therein with a funnel shaped opening for sealably receiving said male portion, said funnel shaped opening connecting through second conduit to the bottom of said container for drawing chemical therethrough; and said male portion is secured in position on an underside of said pressure chamber, said male portion having liquid seal means therearound to prevent said chemical from leaving said container but allowing air through said liquid seal means, said flexible structure having a vent passage therethrough to keep said container at approximately atmospheric pressure.

2. The portable spraying apparatus of claim 1 having a cover means for said nozzle housing, said cover means having a securing means to secure to said housing while simultaneously abutting said nozzle housing to hold said pressure chamber in a fixed, sealing position.

3. The portable spraying apparatus of claim 1 wherein said housing has a first part independently moveable within a given radius with respect to a first part, flexible conduit means for flow communication between said first part and said second part, said air compressor being connected to said first part and said nozzle housing and container being connected to said second part.

4. A portable sprayer having a main sprayer structure and a disposable container engaged therewith, characterized by:

said disposable container comprising first and second connection means at opposite ends thereof;

said main sprayer structure defining an opening receiving said container, said opening having a third and fourth connection means on opposing sides thereof and engaged with said first and second connection means, respectively;

said first and third connection means forming a fluid conduit and held in fluid-tight engagement by pushing of the second connection means over the fourth connection means upon the sliding engagement of said second and fourth connection means;

said opening comprises a notched-out portion of the main sprayer structure defined by said third connection means and said sprayer sidewall; and said disposable container fits said notched-out portion with the container sidewall engaged with the sprayer sidewall.

5. The apparatus of claim 4, wherein: said third connection means is a female element and said first connection means is a male element engaged therewith.

6. The apparatus of claim 4, wherein:

said second connection means is an indentation on said container and said fourth connection means is a locking extension tab slidably engagable therein.

7. The apparatus as set forth in claim 4, wherein;

the main sprayer structure has a needle conduit for rupturing a seal on the disposable container upon abutting engagement of the first and third connection means.

8. The apparatus as set forth in claim 4, wherein:

the main sprayer structure has a porous foam material for abutting the first connection means on the disposable container.

9. The reservoir as set forth in claim 4, wherein:

the disposable container has a metering conduit mounted with the first connection means and extending to adjacent the second connection means.

10. The reservoir as set forth in claim 7, wherein:

the first connection means has a flexible needle conduit seal member having an opening therein for sealingly receiving a needle conduit on the main sprayer structure.

11. The apparatus as set forth in claim 10, wherein:

the first connection means has a thin seal member to prevent spilling of chemical from the disposable container and which is positioned to be ruptured by the needle conduit when inserted in the opening in the needle conduit seal member.

12. The apparatus as set forth in claim 4, wherein:

said disposable container substantially fills said opening and forms a continuity of the main sprayer structure.

13. A portable sprayer having a main sprayer structure and a disposable container engaged therewith, characterized by:

said disposable container comprising first and second connection means at opposite ends thereof;

said main sprayer structure defining an opening receiving said container, said opening having a third and fourth connection means on opposing sides thereof and engaged with said first and second connection means, respectively;

said first and third connection means forming a fluid conduit and held in fluid-tight engagement by the sliding engagement of said second and fourth connection means;

said opening of said main sprayer structure having a sprayer sidewall extending between said third and fourth connection means; and said disposable container having a container sidewall extending between said first and second connection means for mating with said sprayer sidewall to form a continuity of the main sprayer structure.

14. A portable sprayer having a main sprayer structure and a disposable container engaged therewith, characterized by:

said disposable container comprising first and second connection means at opposite ends thereof;

said main sprayer structure defining an opening receiving said container, said opening having a third and fourth connection means on opposing sides thereof and engaged with said first and second connection means, respectively;

said first and third connection means forming a fluid conduit and held in fluid-tight engagement by the sliding engagement of said second and fourth connection means;

said main sprayer structure having a sprayer base supporting portion; and said disposable container having a container base supporting portion which forms an extension of the sprayer base supporting structure when said second and fourth connection means are slidably engaged.

* * * * *